US005775756A

United States Patent [19]

Rozenich

[11] Patent Number: 5,775,756

[45] Date of Patent: Jul. 7, 1998

[54] SECURE GRIPPING SYSTEM

[76] Inventor: Robert Rozenich, P.O. Box 5595, Lansing, Ill. 60438

[21] Appl. No.: 627,891

[22] Filed: Apr. 3, 1996

[51] Int. Cl.[6] ..... A63B 21/072

[52] U.S. Cl. ..... 294/137; 16/114 R; 482/106

[58] Field of Search ..... 294/25, 57, 58, 294/137, 171; 16/114 R, 116 R, 116 A, DIG. 12; 74/551.9; 473/298–301, 568; 482/106, 108

[56] References Cited

U.S. PATENT DOCUMENTS

| | | | |
|---|---|---|---|
| 770,336 | 9/1904 | Terry . | |
| 808,737 | 1/1906 | Fairbrother . | |
| 814,570 | 3/1906 | Stockdell . | |
| 1,552,073 | 9/1925 | Mansfeldt . | |
| 1,637,120 | 7/1927 | Larson | 16/DIG. 12 |
| 1,980,655 | 11/1934 | Balistreri | 473/299 |
| 2,050,176 | 8/1936 | Hammerich | 473/301 |
| 2,425,245 | 8/1947 | Johnson | 294/137 |
| 2,466,719 | 4/1949 | MacKearnin | 74/551.9 |
| 2,528,213 | 10/1950 | Dantolan | 272/84 |
| 3,084,938 | 4/1963 | Kapanowski | 473/568 |
| 3,326,550 | 6/1967 | Melchiona | 272/68 |
| 3,756,597 | 9/1973 | Monti | 272/81 |
| 3,904,198 | 9/1975 | Jones | 272/81 |
| 4,021,040 | 5/1977 | Inoue | 272/123 |
| 4,262,385 | 4/1981 | Norman | 294/171 |
| 4,487,412 | 12/1984 | Meeko | 272/123 |
| 4,722,296 | 2/1988 | Bowskill et al. | 16/114 R |
| 4,746,120 | 5/1988 | Mockovak | 473/301 |
| 4,809,974 | 3/1989 | Buhr | 294/25 |
| 5,125,130 | 6/1992 | Stanish | 294/57 |
| 5,300,001 | 4/1994 | Sealy | 482/106 |
| 5,427,376 | 6/1995 | Cummings et al. | 473/300 |
| 5,469,601 | 11/1995 | Jackson | 16/114 R |
| 5,511,445 | 4/1996 | Hildebrandt | 16/116 R |

OTHER PUBLICATIONS

*"New. Smarter dumbells"*, Soloflex ® Brochure, ©1995 Soloflex, Inc.

Advertisment for "Grip", Performance Marketing, Jan. 1996, p. 43.

*Primary Examiner*—Dean Kramer
*Attorney, Agent, or Firm*—Wallenstein & Wagner, Ltd.

[57] ABSTRACT

A system and method for providing a secure resilient hand grip on a bar. The system includes a gripping pad having a first surface and an opposing second surface which contacts the bar. The gripping pad is preferably formed of rubber and is placed onto the bar by wrapping the gripping pad around a first portion of the bar. The gripping pad can have a radius of curvature to help ensure that it does not unwrap from the bar on its own. Two gripping pads, one for each hand, can be utilized for use with a weightlifting bar.

15 Claims, 1 Drawing Sheet

SECURE GRIPPING SYSTEM

DESCRIPTION

1. Technical Field

This invention relates generally to a method and a system or device for providing a secure, resilient gripping surface on a bar, and more particularly relates to a resilient gripping pad which is easily wrapped or secured to a bar, such as a weightlifting bar, to provide a secure hand gripping surface on the bar, and to a method of providing an easily adjustable and removable secure resilient gripping surface on a bar.

2. Background of the Invention

Maintaining a secure comfortable grip is extremely important when operating or using various hand held apparatuses. For example, a secure grip is particularly important when using weightlifting equipment, such as a weightlifting bar or dumbbells. A secure grip on the weightlifting bar or the handle of the dumbbell can facilitate the use of greater weight, or increase the number of repetitions made during a particular exercise. Additionally, a secure grip is necessary to avoid accidentally dropping the weightlifting bar or dumbbell, which could result in injury to the user or others, or damage to the exercise equipment.

One method used by weightlifters to provide a secure grip is to coat their hands with rosin. This will make the weightlifter's hands sticky and allow the weightlifter to grip the bar without slipping. However, rosin has a tendency to build up on the weightlifting equipment which necessitates periodically cleaning the equipment to remove the built-up rosin.

Weightlifting gloves are also used by weightlifters to provide a more secure grip on the weightlifting bar. Some gloves are padded to provide a limited amount cushioning in the palm area. However, use of weightlifting gloves increases sweating of the hands during exercising, which permeates the gloves. When the sweat dries, the gloves can become stiff and useless.

Another method used to provide a secure grip is to add a rough textured surface on the weightlifting bar. However, a rough textured surface can cause blistering or abrasions on the hands.

Some weightlifting equipment, such as the Soloflex® dumbbell, include a cushioned surface permanently attached to the bar or handle area. However, placement of such a surface significantly increases the price of the weightlifting equipment. Further, the permanently placed surface cannot be removed and used on other weightlifting equipment or apparatuses.

Canvas strips have also been utilized to provide a secure grip on a weightlifting bar. A portion of a canvas strap, approximately 1.5 inches wide, is wrapped around the wrist, and the remaining portion is wrapped around the weightlifting bar. However, the strap must be unwrapped each time the user leaves the bar and rewrapped for the next use.

The present system and method are designed to overcome the problems associated with maintaining a secure resilient grip on a bar.

SUMMARY OF THE INVENTION

The present invention is a method and system or device for providing a secure resilient gripping surface on a bar. The gripping surface is easily secured to the bar, and can be easily removed from the bar. Thus, the gripping surface can be readily adjusted to the proper position on a bar, and can be used on a variety of different bars.

The system for providing a secure resilient gripping surface on a bar comprises a flexible pad having a first outward gripping surface and an opposing second surface. The pad is wrapped completely around a first portion of the bar wherein at least a portion of the pad overlaps so that a portion of the second surface of the pad contacts and adheres to a portion of the first surface of the pad. The pad is removable from the first portion of the bar by unwrapping the gripping pad from the first portion of the bar. Preferably, the pad is somewhat stretched when wrapped around the bar.

The gripping pad is formed from a compressible and flexible material to provide a cushioned resilient gripping surface on the bar. Rubber is one preferred compressible and flexible material which can be used. A rubber gripping pad has a natural adhesion which enables a portion of the second surface of the pad to adhere to a portion of the first surface.

The pad can be formed to have a predetermined radius of curvature or domed shape wherein the first surface of the pad has a convex shape, and the second surface of the pad has a concave shape. This curvature will inhibit the gripping pad from unwrapping from the bar on its own.

When applied to a weightlifting bar, two gripping pads can be utilized, one for each hand.

The gripping pad of the present invention is not permanently secured to the bar. That is, the gripping pad can be simply removed by unwrapping the gripping pad from around the bar. This allows the gripping pad to be easily adjustable. It can be placed on one portion of a bar and then quickly removed and placed on a second portion of the bar. When used with weightlifting equipment, such as a weightlifting bar or a dumbbell, the disk-shaped weights do not have to be removed in order to secure or remove the gripping pad on the bar. Additionally, the same gripping pad can be used on a multitude of different bars.

The method of providing an easily adjustable and removable secure gripping surface on a bar comprises the steps of providing a bar, and a flexible resilient pad having a first outward gripping surface and an opposing second surface. The method further includes wrapping the pad around a first portion of the bar so that the pad overlaps and at least a portion of the second surface of the pad contacts and adheres to a portion of the first surface.

The wrapping step of the method can comprise slightly stretching the pad as the pad is being wrapped around the first portion of the bar. This will help ensure that the pad is maintained on the bar when in use.

The method may further include steps for adjusting the gripping pad. The gripping pad can be easily adjusted by unwrapping the pad from the first portion of the bar, and wrapping the pad around a second portion of the bar.

The method also may include providing a second gripping pad and wrapping the second pad around a second portion of the bar.

Further aspects of the invention are evident from the Detailed Description of the Preferred Embodiment, and FIGS. 1–3.

DETAILED DESCRIPTION OF THE PREFERRED EMBODIMENT

Figure 1:
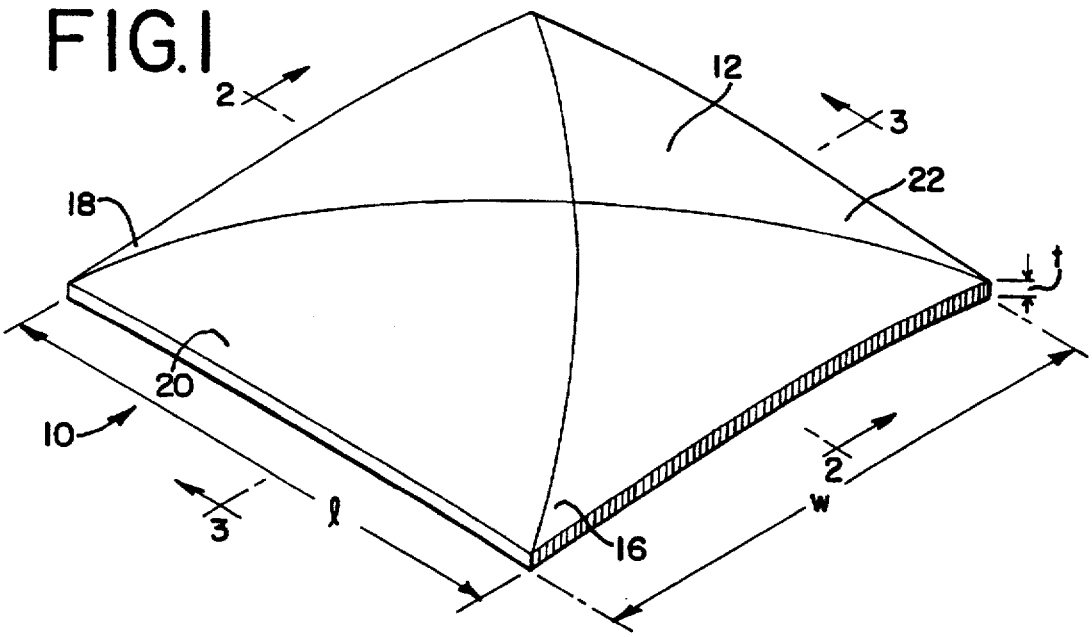
FIG. 1 is a perspective view of an embodiment of a gripping pad of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The system of the present invention is designed to provide a secure resilient gripping surface on a bar which is grasped by a hand. The system is preferably utilized with weightlifting equipment, such as a weightlifting bar. However, it is readily apparent that other types of equipment can be utilized with this system.

In the preferred form, a flexible gripping pad is provided which is easily secured to a weightlifting bar by wrapping the gripping pad around a portion of the bar. The gripping pad will provide a comfortable resilient gripping surface which will enhance the ability to grip and utilize the weightlifting bar during various exercises with the bar.

Figure 2:
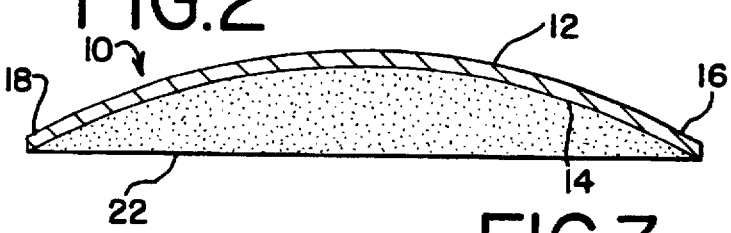
FIG. 2 is a cross-sectional view of the gripping pad of FIG. 1 taken along the line 2—2.

FIGS. 1 and 2 disclose a gripping pad 10 for use in the present system. The gripping pad 10 has a generally rectangular first surface 12 and a generally rectangular second surface 14 opposing the first surface 12. The first and second surfaces 12, 14 respectively include a first end 16, a second end 18 opposing the first end 16, a first side 20, and an opposing second side 22. The first and second surfaces 12, 14 are separated by the thickness "t" of the gripping pad.

The gripping pad 10 is preferably formed from a compressible rubber material, which provides a comfortable secure grip when used on a bar as described below. The gripping pad 10 preferably has a thickness t of approximately 1/16 inches. Accordingly, the pad will not significantly increase the circumference of the bar.

Figure 3:
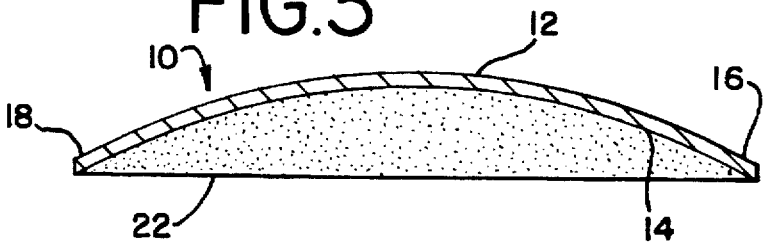
FIG. 3 is a cross-sectional view of the gripping pad of FIG. 1 taken along the line 3—3.
Figure 4:
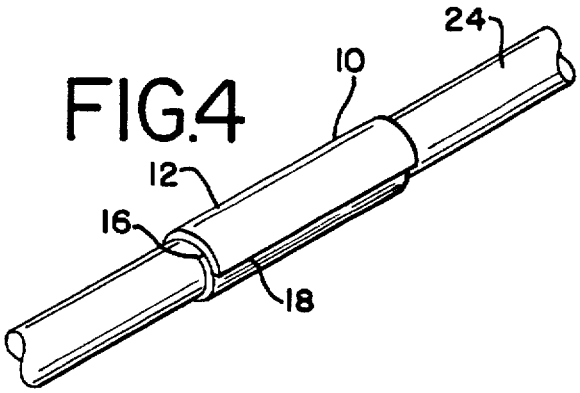
FIG. 4 is a perspective view of a gripping pad stretched around a portion of a bar and forced to conform with the cylindrical shape of the bar in accordance with the present invention.
Figure 5:
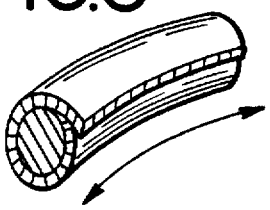
FIG. 5 is a perspective view of the gripping pad of FIG. 4 when not in use around a bar.

The gripping pad 10 is easily secured to a portion of a weightlifting bar 24 (shown in FIG. 3) by positioning the first end 16 of the second surface 14 of the gripping pad 10 on the weightlifting bar 24, and wrapping the gripping pad 10 around the circumference of the weightlifting bar 24 so that the pad 10 overlaps itself and a portion of the second surface 14 contacts and adheres to a portion of the first outward surface 12. The gripping pad 10 is slightly stretched when wrapped around the weightlifting bar 24 to help ensure that the gripping pad 10 adheres to and remains secured to itself when in use.

The gripping pad 10 is easily removed by unwrapping the gripping pad 10 from the weightlifting bar 24. In this manner, the gripping pad can be easily adjusted to an appropriate position on the weightlifting bar 24.

In the preferred form, the second surface 14 of the gripping pad 10, which contacts the weightlifting bar 24 when wrapped around a portion of the bar 24, will have a natural adhesion. This will help ensure that the gripping pad 10 remains secured to the weightlifting bar 24 during use, and prevents the gripping pad from sliding along the length of the weightlifting bar 24.

FIG. 2 discloses another preferred feature which will help ensure that the gripping pad 10 is properly secured to the weightlifting bar 24. As shown in cross-section, the gripping pad 10 has a predetermined radius of curvature or domed shape which causes the second surface 14 to have a concave shape and the first surface 12 to have a convex shape. The radius of curvature will facilitate the gripping pad 10 to conform to the shape of the weightlifting bar 24 and will inhibit the gripping pad 10 from unwrapping on its own. Gripping pads having a radius of curvature can be manufactured by cutting generally rectangular sections from an inner tube type structure, such as a motorcycle inner tube.

When placed on the weightlifting bar 24, the first surface 12 is directed outwardly, and is contacted by the hand when gripped.

In one embodiment of the system, first and second gripping pads 10 are utilized with the weightlifting bar 24, one for each hand. In this form, the gripping pads 10 preferably have a length "l" of approximately 5¼ inches and a width "w" of approximately 4¾ inches. However, the gripping pads 10 can be formed so that the length more closely corresponds to the particular circumference of the weightlifting bar 24 being used.

The first gripping pad 10 is secured to a first portion of the weightlifting bar 24 by wrapping it around the first portion as described above. Similarly, the second gripping pad 10 is secured to a second portion of the weightlifting bar 24 in an identical manner. The first and second gripping pads 10 should be spaced apart on the weightlifting bar 24 a sufficient distance to provide the correct position of the hands for a particular exercise. The first and second gripping pads 10 can also be used on first and second dumbbell bars.

While a specific embodiment has been illustrated and described, numerous modifications come to mind without markedly departing from the spirit of the invention. The scope of protection is thus only intended to be limited by the scope of the accompanying claims.

I claim:

1. A system for providing a secure resilient gripping surface on a bar comprising:

an adjustable flexible first pad having a first outward gripping surface and an opposing second surface, said first pad consisting of a single layer of rubber having a constant thickness of approximately 1/16 inches, said first pad wrapped around a first portion of said bar wherein at least a portion of said pad overlaps so that a portion of said second surface of said first pad contacts and adheres to a portion of said first surface, said first pad being removable from said first portion of said bar by unwrapping said first pad from said first portion of said bar; and, a flexible second pad having a first outward surface and an opposing second surface, said second pad wrapped around a second portion of said bar wherein at least a portion of said second pad overlaps so that a portion of said second surface of said second pad contacts and adheres to a portion of said first surface of said second pad, said second pad being removable from said second portion of said bar by unwrapping said second pad from said bar.

2. The system of claim 1 wherein said second pad comprises rubber.

3. The system of claim 1 wherein said first pad has a predetermined radius of curvature wherein said first surface of said first pad has a convex shape, and said second surface of said first pad has a concave shape.

4. The system of claim 1 wherein said first pad is generally rectangular, said first pad having a length of approximately 5.25 inches and a width of approximately 4.75 inches.

5. The system of claim 1 wherein said second pad has a thickness of approximately 1/16 inches.

6. The system of claim 1 wherein said second pad has a predetermined radius of curvature wherein said first surface of said first pad has a convex shape, and said second surface of said first pad has a concave shape.

7. A system for providing an easily adjustable and removable resilient gripping surface on a bar comprising a first adjustable flexible resilient pad having a first outward gripping surface and an opposing second surface, said first pad consisting of a single layer of rubber having a constant thickness of approximately 1/16 inches, said first pad wrapped around a first portion of said bar wherein a portion of said first pad overlaps so that a portion of said second surface of said first pad contacts and adheres to a portion of said first surface of said first pad, and a second adjustable flexible resilient pad having a first outward gripping surface and an opposing second surface, said second pad consisting of a single layer of rubber having a constant thickness of approximately 1/16 inches, said second pad wrapped around a second portion of said bar spaced apart from said first portion of said bar wherein a portion of said second pad overlaps so that a portion of said second surface of said second pad contacts and adheres to a portion of said first surface of said second pad.

8. The system of claim 7 wherein said first and second pads have predetermined radii of curvature wherein said first surfaces of said first and second pads have a convex shape, and said second surfaces of said first and second pads have a concave shape.

9. The system of claim 7 wherein said second pad comprises rubber.

10. The system of claim 7 wherein said first pad is generally rectangular, said first pad having a length of approximately 5.25 inches and a width of approximately 4.75 inches, and said second pad is generally rectangular, said second pad having a length of approximately 5.25 inches and a width of approximately 4.75 inches.

11. A method of providing an easily adjustable and removable secure gripping surface on a bar comprising the steps of:

providing said bar;

providing a flexible resilient first pad having a first outward gripping surface and an opposing second surface, said first pad consisting of a single layer of rubber having a constant thickness of approximately 1/16 inches;

wrapping said first pad around a first portion of said bar wherein said first pad overlaps so that at least a portion of said second surface of said first pad contacts and adheres to a portion of said first surface;

providing a flexible resilient second pad having a first outward gripping surface and an opposing second surface; and, wrapping said second pad around a second portion of said bar wherein said second pad overlaps so that at least a portion of said second surface of said second pad contacts and adheres to a portion of said first surface of said second pad.

12. The method of claim 11 further comprising the steps of:

unwrapping said first pad from said first portion of said bar; and wrapping said first pad around a second portion of said bar wherein said first pad overlaps so that at least a portion of said second surface of said first pad contacts and adheres to a portion of said first surface.

13. The method of claim 11 wherein said wrapping step comprises slightly stretching said first pad as said first pad is being wrapped around said first portion of said bar.

14. The method of claim 11 wherein said wrapping step comprises slightly stretching said second pad as said second pad is being wrapped around said second portion of said bar.

15. The method of claim 11 wherein said providing said pad step comprises providing a rectangular piece of rubber having a length of approximately 5.25 inches, and a width of approximately 4.75 inches, and having a concave surface and an opposing convex surface.

* * * * *